US007217898B2

(12) United States Patent
Chien et al.

(10) Patent No.: US 7,217,898 B2
(45) Date of Patent: May 15, 2007

(54) ROCKING KEY AND ELECTRICAL SWITCH ASSEMBLY EMPLOYING THE SAME

(75) Inventors: Chih-Wei Chien, Guangdong (CN); Chang-Hsuan Chen, Guangdong (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,010

(22) Filed: Jun. 8, 2006

(65) Prior Publication Data

US 2007/0062797 A1 Mar. 22, 2007

(30) Foreign Application Priority Data

Sep. 16, 2005 (CN) ..... 2005 1 0037348

(51) Int. Cl.
*H01H 13/70* (2006.01)

(52) U.S. Cl. ..... 200/339; 200/5 A

(58) Field of Classification Search ..... 200/5 A, 200/5 R, 341–345; 341/22.35; 345/158–169; 361/680

See application file for complete search history.

(56) References Cited

U.S. PATENT DOCUMENTS 4,438,304 A * 3/1984 Kennedy ..... 200/406
4,654,488 A * 3/1987 Westfall ..... 200/5 R
5,285,039 A * 2/1994 Satoh ..... 200/563
5,338,909 A * 8/1994 Stanley et al. ..... 200/339
5,560,475 A * 10/1996 Brundage et al. ..... 200/315
5,564,559 A * 10/1996 Chen ..... 200/339
5,692,044 A 11/1997 Hughes et al.
5,834,716 A * 11/1998 Lee ..... 200/5 R
6,037,552 A * 3/2000 Yamada ..... 200/339
6,148,183 A 11/2000 Higdon et al.
6,466,769 B1 10/2002 Kobayashi et al.
6,608,270 B2 * 8/2003 Donofrio et al. ..... 200/302.1
6,670,727 B2 * 12/2003 Lee et al. ..... 307/140

* cited by examiner

*Primary Examiner*—Michael Friedhofer
*Assistant Examiner*—Lisa Klaus
(74) *Attorney, Agent, or Firm*—Winston Hsu

(57) ABSTRACT

A rocking key includes a keycap and a pair of supporting arms. The keycap includes at least two posts, a rib portion positioned between the two posts for preventing the two posts from being simultaneously depressed downwardly. The supporting arms are arranged at two opposite sides of the keycap for resiliently supporting the keycap.

18 Claims, 7 Drawing Sheets

ROCKING KEY AND ELECTRICAL SWITCH ASSEMBLY EMPLOYING THE SAME

FIELD OF THE INVENTION

The present invention relates to a function key and, more particularly, to a rocking key and an electrical switch assembly employing the same.

DESCRIPTION OF RELATED ART

In recent years, electronic apparatuses, such as wireless communication apparatuses and portable computers, have undergone significant reductions in size, and thus have become easier to transport and to be used in various environments. In these electronic apparatuses, electrical switches or switch assemblies with rocking keys are generally applied for users to operate. The rocking keys may generally be used as direction control inputting components which can be switched to move cursors on screens of the electronic apparatuses forward/backward or upward/downward.

The electrical switch assemblies and, particularly, the rocking keys are reduced in size in order to be compatible within the electronic apparatuses. However, a center portion of the rocking key is liable to be depressed because the rocking key is small. The rocking key is deformed because it is generally made of resilient plastic. Two ends of the rocking key move downward at the same time to activate a relative circuit. Reliability of the electrical switch assembly may be adversely affected.

Therefore, a rocking key and an electrical switch assembly employing the same with high reliability are desired.

SUMMARY OF THE INVENTION

A rocking key including a keycap and a pair of supporting arms is provided. The keycap includes at least two posts, a rib portion positioned between the two posts for preventing the two posts from being simultaneously depressed downwardly. The supporting arms are arranged at two opposite sides of the keycap for resiliently supporting the keycap.

Other advantages and novel features will become more apparent from the following detailed description of preferred embodiments when taken in conjunction with the accompanying drawings, in which:

DETAILED DESCRIPTION OF THE INVENTION

In the following embodiments, a portable computer is used as an example for illustration. It is noted that electronic apparatuses in these embodiments may be portable computers, mobile phones or any other electronic apparatuses.

Figure 1:
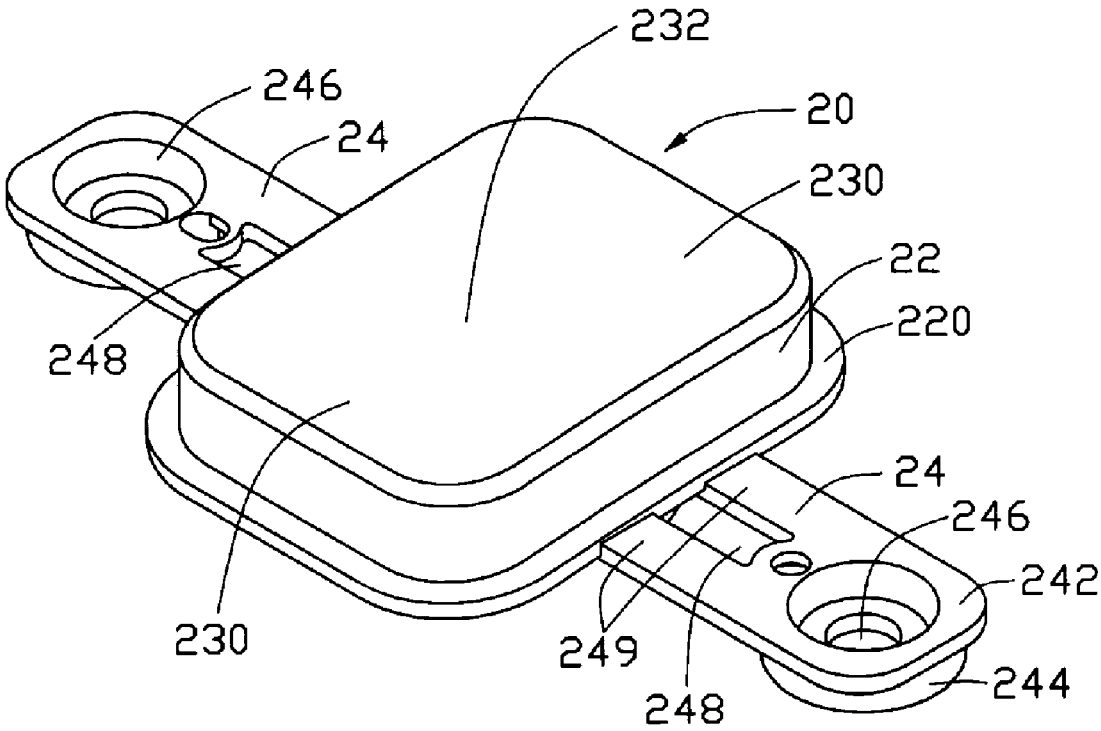
FIG. 1 is an isometric view of a rocking key in accordance with a first exemplary embodiment.
Figure 2:
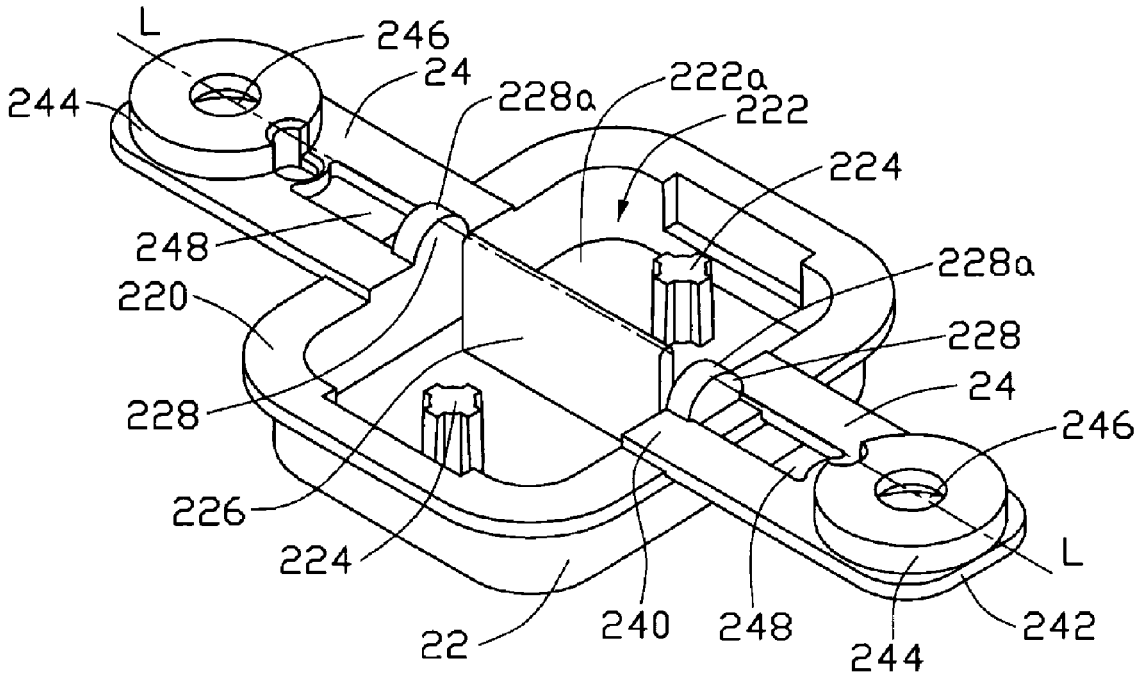
FIG. 2 is a reversed, isometric view of the rocking key of FIG. 1.
Figure 3:
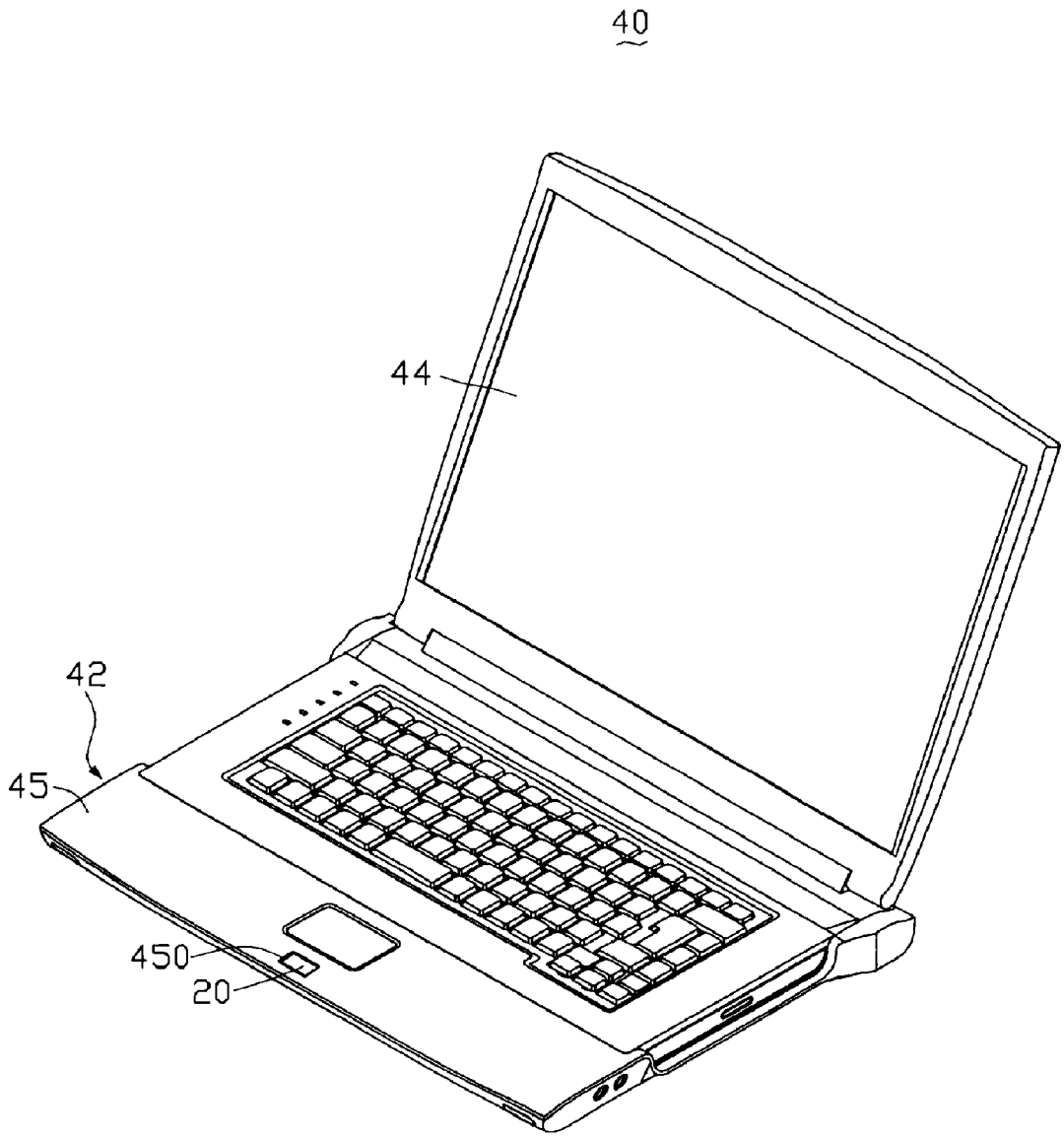
FIG. 3 is an isometric view of a portable computer, with the rocking key of FIG. 1 being accommodated therein.
Figure 4:
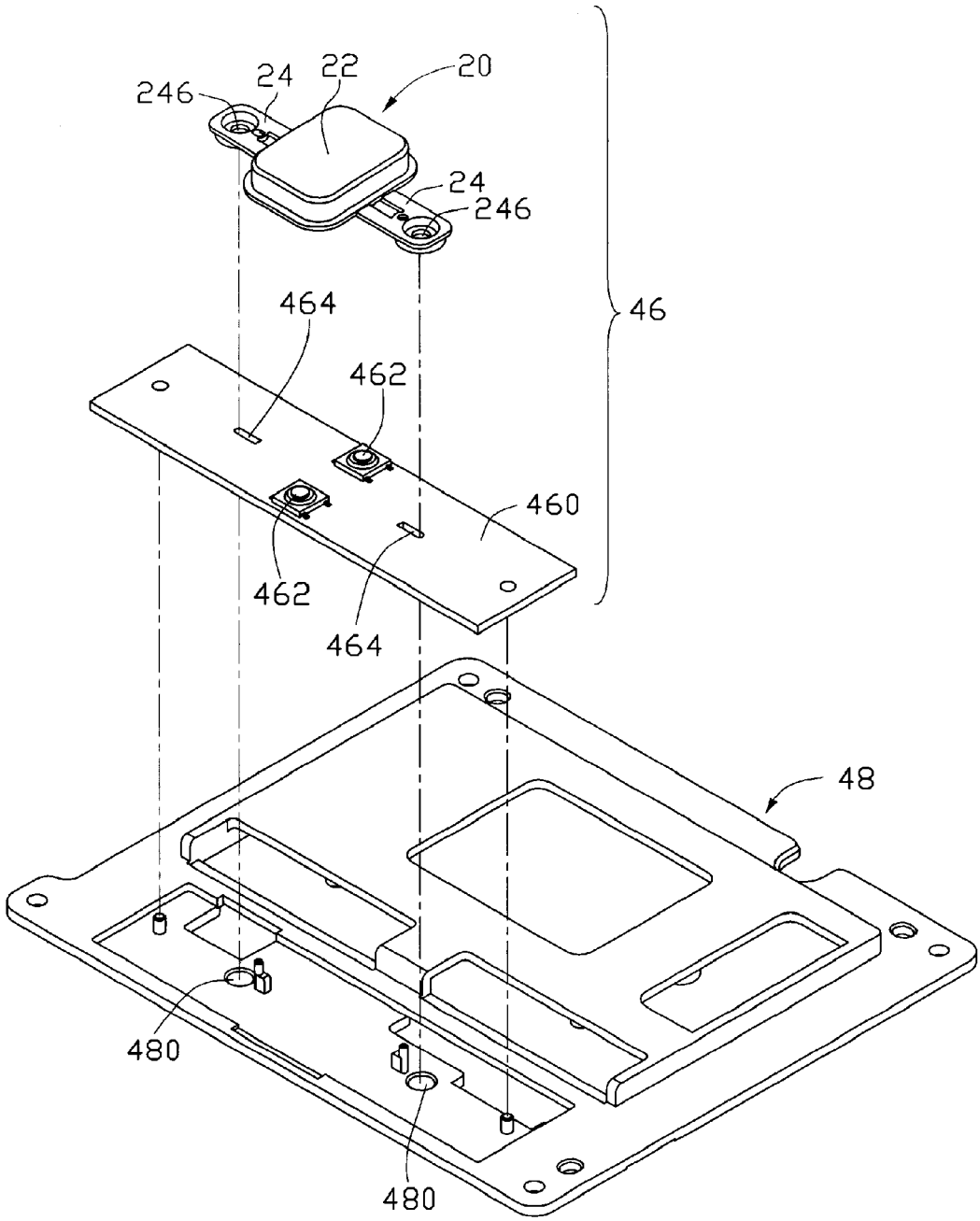
FIG. 4 is an exploded, isometric view of the portable computer of FIG. 3, with an electrical switch assembly employing the rocking key and a baseboard being remained thereof.
Figure 5:
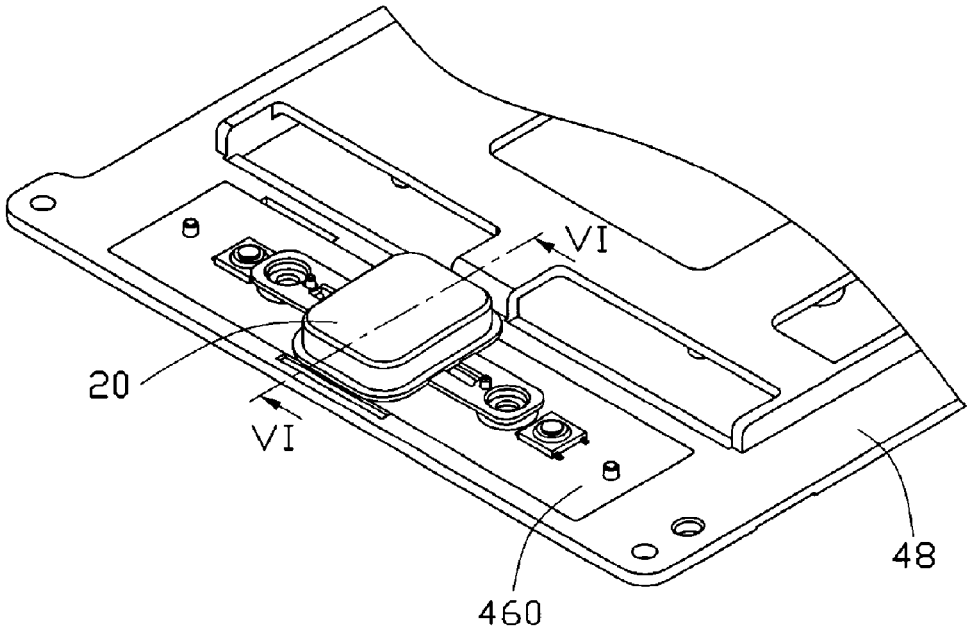
FIG. 5 is an assembled, isometric view of the electrical switch assembly and the baseboard of FIG. 4.
Figure 6:
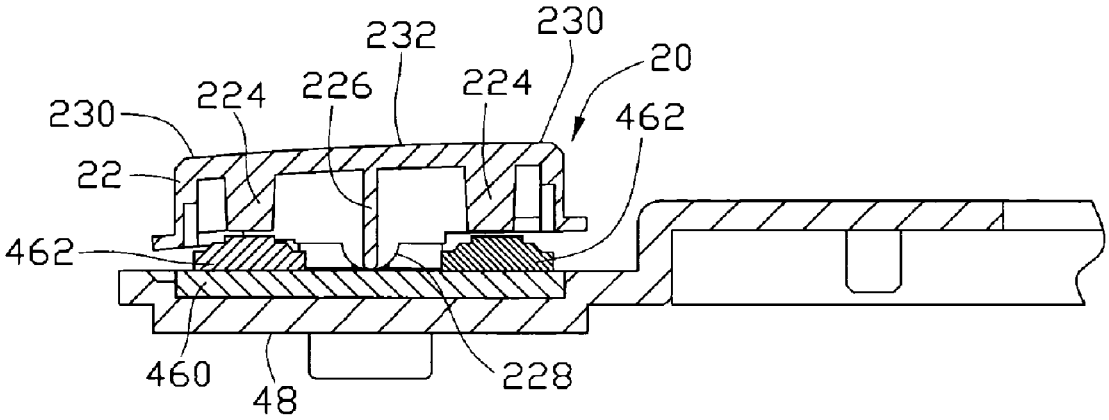
FIG. 6 is a cross-sectional view of the assembly of the electrical switch assembly and the baseboard of FIG. 5, taken along line VI—VI.

Referring to FIGS. 1 and 2, a rocking key 20 includes a keycap 22 and a pair of supporting arms 24 arranged at two opposite sides of the keycap 22. The keycap 22 includes a flange 220, a pair of posts 224, a rib portion 226, and a pair of trunnions 228. A recess portion 222 is defined in the keycap 22. On a top of the keycap 22, two opposite end portions 230 are depressible, and a center portion 232 interconnects the two end portions 230.

The flange 220 is formed around and extends out from a periphery of the recess portion 222. The pair of posts 224 perpendicularly extend from a first bottom 222*a* of the recess portion 222. The rib portion 226 perpendicularly extends from the first bottom 222*a* of the recess portion 222 as well. The rib portion 226 is constructed as a board shape. The pair of posts 224 are symmetrically arranged at two opposite sides of the rib portion 226. A height of the rib portion 226 is larger than that of each post 224. The pair of trunnions 228 perpendicularly extend from the flange 220, and are arranged along a longitudinal direction of the rib portion 226. A height from the first bottom 222*a* to a second bottom 228*a* of each trunnion 228 is larger than or equal to that of the rib portion 226.

The pair of supporting arms 24 oppositely extend from opposite sides of the flange 20, along the longitudinal direction of the rib portion 226. Each supporting arm 24 is flexible, and includes a fixed end 240 attached to the flange 20, a free end 242 and a washer 244 are integrally formed under the free end 242. A first fixing hole 246 is defined through the free end 242 and the washer 244. A longitudinal slot 248 is defined in each supporting arm 24 from the fixed end 240 to a circumference of the washer 244. Each supporting arm 24 is thus partially divided into two spring portions 249 to improve its flexibility and restorability performance when being bent.

Referring also to FIGS. 3 to 6, a portable computer 40 employing at least one rocking key 20 is illustrated. The portable computer 40 includes a main body 42 and a display unit 44 pivoted to the main body 42. The main body 42 includes a housing 45, a switch assembly 46 and a baseboard 48. The switch assembly 46 is accommodated in the housing 45 and includes at least one rocking key 20, a circuit board 460, and a pair of switches 462 mounted on the circuit board 460. The keycap 22 partially passes through a hole 450 defined in the housing 45, and the flange 220 of the rocking key 20 is blocked by the housing 45. A top portion of the keycap 22 is exposed out of the housing 45. A pair of fixing slots 464 are defined in the circuit board 460 and each corresponds to the first fixing holes 246. The switches 462 each corresponds to the pair of the post 224. The baseboard 48 defines a pair of second fixing holes 480 corresponding to the first fixing holes 246. A pair of bolts (not shown) are correspondingly and sequentially screwed through the first fixing holes 246, the fixing slots 464, and the second fixing holes 480 so as to secure the rocking key 20 and the switch 46 to the baseboard 48. The supporting arms 24 are deformable because they are flexible. The keycap 22 is rotatably supported by the pair of trunnions 228 and the supporting arms 24.

When a user presses one end portion 230 of the keycap 22, the pair of supporting arms 24 are deformed, and thus the keycap 22 rotates around a line L—L connecting the pair of trunnions 228. Once the post 224 presses the corresponding switch 462, a circuit (not shown) is activated. During this process, another opposite post 224 is separated from its corresponding switch 462. When the user accidentally presses the center portion 232 of the keycap 22, the keycap 22 does not move downward or moves slightly downward because of the support of the rib portion 226. Therefore, potential, adverse affects to a reliability of the electrical switch assembly may be avoided because the two posts 224 cannot be simultaneously in contact with the corresponding switches 462.

Figure 7:
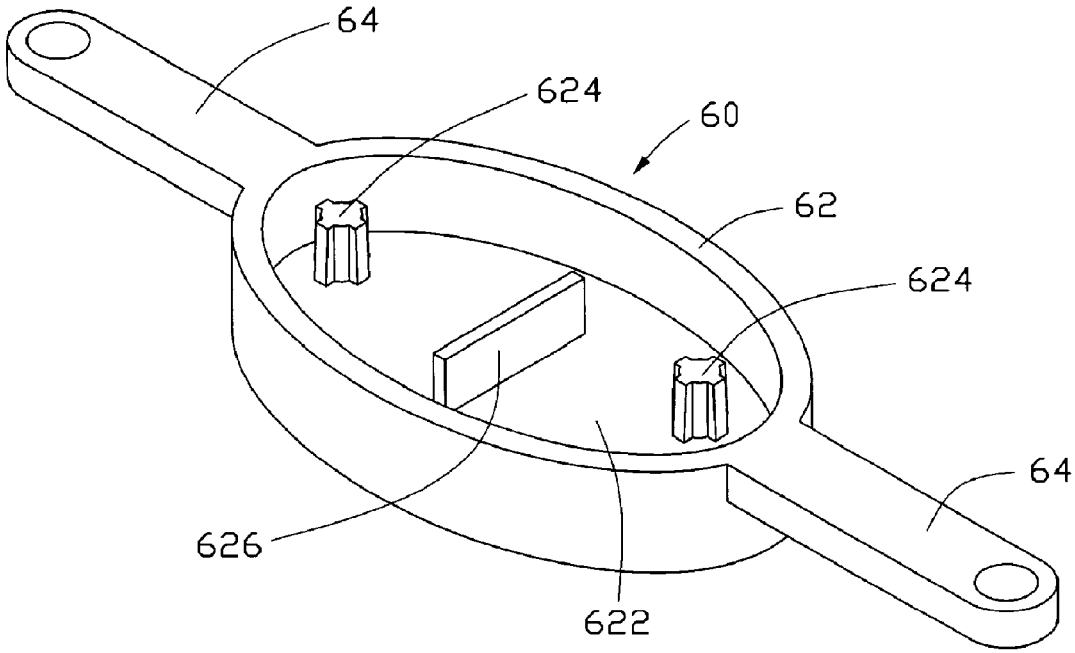
FIG. 7 is an isometric view of a rocking key of an electrical switch in accordance with a second exemplary embodiment.

Referring to FIG. 7, a rocking key 60 in accordance with a second embodiment is illustrated. The rocking key 60 includes a keycap 62 and a pair of supporting arms 64. The keycap 62 includes a pair of posts 624, and a rib portion 626. A recess portion 622 is defined in the keycap 62. The pair of posts 624 and the rib portion 626 perpendicularly extend from a bottom of the recess portion 622. The pair of posts 624 are symmetrically arranged at two opposite sides of the rib portion 626. The supporting arms 64 are also symmetrically arranged at two opposite sides of the rib portion 626. A height of the rib portion 626 is larger than that of each post 624. The rib portion 626 is high enough to prevent the two posts 624 from being depressed down at the same time. The rib portion 626 also acts as a shaft around which the keycap 62 can rotate.

In alternative embodiments, the number of the posts 224 is not limited to two; three or more posts may be applied in the recess portion 222. The number of the supporting arms 24 is also not limited to two; three or more supporting arms may be used. The flange 220 may be omitted if the fixed ends 240 of the supporting arms 24 are attached to the periphery of the keycap 20.

The embodiments described herein are merely illustrative of the principles of the present invention. Other arrangements and advantages may be devised by those skilled in the art without departing from the spirit and scope of the present invention. Accordingly, the present invention should be deemed not to be limited to the above detailed description, but rather by the spirit and scope of the claims that follow, and their equivalents.

What is claimed is:

1. A rocking key comprising:

a keycap comprising at least two posts, a rib portion positioned between the two posts for preventing the two posts from being simultaneously depressed downwardly; and at least two supporting arms arranged at two opposite sides of the keycap for resiliently supporting the keycap, the supporting arm comprising a fixed end connecting to the keycap, an opposite free end, and a washer formed under the free end.

2. The rocking key as claimed in claim 1, wherein the keycap defines a recess portion where the two posts and the rib portion are arranged.

3. The rocking key as claimed in claim 1, wherein a height of the rib portion is configured larger than the height of each post.

4. The rocking key as claimed in claim 1, wherein a pair of trunnions substantially perpendicularly extend from a periphery of the keycap for pivotally supporting the keycap.

5. The rocking key as claimed in claim 4, wherein the pair of trunnions are arranged along a longitudinal direction of the rib portion.

6. The rocking key as claimed in claim 4, wherein a height from a first bottom of the recess portion to a second bottom of the corresponding trunnion is larger than or equal to that of the rib portion.

7. The rocking key as claimed in claim 1, wherein the supporting arm is made of flexible material, and a first fixing hole is defined through the free end and the washer.

8. The rocking key as claimed in claim 7, wherein a slot is defined in each supporting arm from the fixed end to an edge of the washer.

9. The rocking key as claimed in claim 1, wherein a flange is formed around and extends out from a periphery of the keycap for blocking the keycap when the keycap is assembled in a hole.

10. The rocking key as claimed in claim 1, wherein the supporting arm is made of flexible material, and a first fixing hole is defined through the free end and the washer.

11. The electrical switch assembly as claimed in claim 10, wherein a slot is defined in each supporting arm from the fixed end to an edge of the washer.

12. An electrical switch assembly comprising:

at least one circuit board;

at least two switches electrically connected to the circuit board; and a rocking key comprising:

a keycap comprising at least two posts for applying pressure to the corresponding switches, a rib portion positioned between the two posts for preventing the two posts from simultaneously contacting the corresponding switches; and at least two supporting arms arranged at two opposite sides of the keycap and secured on the circuit board, the supporting arm comprising a fixed end connecting to the keycap, an opposite free end, and a washer formed under the free ends.

13. The electrical switch assembly as claimed in claim 12, wherein the keycap defines a recess portion where the two posts and the rib portion are arranged.

14. The electrical switch assembly as claimed in claim 12, wherein a height of the rib portion is configured to be larger than the height of the corresponding post.

15. The electrical switch assembly as claimed in claim 12, wherein a pair of trunnions substantially perpendicularly extend from a periphery of the keycap and toward the circuit board for pivotally supporting the keycap.

16. The electrical switch assembly as claimed in claim 15, wherein the pair of trunnions are arranged along a longitudinal direction of the rib portion.

17. The electrical switch assembly as claimed in claim 15, wherein a height from a first bottom of the recess portion to a second bottom of the corresponding trunnion is larger than or equal to the height of the rib portion.

18. The electrical switch assembly as claimed in claim 12, wherein a flange is formed around and extends out from a periphery of the keycap for blocking the keycap when the keycap is assembled in a hole.

* * * * *